United States Patent [19]

Karabedian et al.

[11] Patent Number: 4,911,290

[45] Date of Patent: Mar. 27, 1990

[54] CONTAINER PACKAGE

[75] Inventors: James A. Karabedian, Toledo; David A. Pratt, Waterville, both of Ohio

[73] Assignee: Owens-Illinois Plastic Products Inc., Toledo, Ohio

[21] Appl. No.: 319,775

[22] Filed: Mar. 7, 1989

[51] Int. Cl.[4] ..... B65D 71/00

[52] U.S. Cl. ..... 206/151; 206/150; 206/161; 206/459

[58] Field of Search ..... 206/145, 147, 150, 158, 206/161, 459

[56] References Cited

U.S. PATENT DOCUMENTS

| | | | |
|---|---|---|---|
| 3,200,944 | 8/1965 | Rapata | 206/161 |
| 3,317,234 | 5/1967 | Burford | 206/145 |
| 3,601,439 | 8/1971 | Poupitch | 206/145 X |
| 3,627,121 | 12/1971 | Deasy | 206/151 |
| 3,874,502 | 4/1975 | Weaver | 206/161 X |
| 4,116,331 | 9/1978 | Curry et al. | 206/150 |
| 4,219,117 | 8/1980 | Weaver et al. | 206/150 |
| 4,289,236 | 9/1981 | Ganz et al. | 206/459 X |
| 4,385,690 | 5/1983 | Olsen | 206/150 |
| 4,385,691 | 5/1983 | Klygis | 206/150 |
| 4,471,010 | 9/1984 | McBriarty | 206/150 |
| 4,501,104 | 2/1985 | Griffin et al. | 206/150 X |
| 4,520,924 | 6/1985 | Edwards et al. | 206/150 |
| 4,586,742 | 5/1986 | Lew | 206/150 X |
| 4,592,466 | 6/1986 | Walters et al. | 206/150 |
| 4,724,655 | 2/1988 | Lew | 206/150 X |

*Primary Examiner*—William Price

[57] ABSTRACT

A container package comprising an array of cans, each of which has an annular bead on the upper end thereof and a carrier. The carrier includes a sheet of flexible plastic material having a plurality of openings forming an array for receiving the ends of the cans a film of plastic material coextensive with the sheet and bonded to the periphery of the sheet so that it is flat and taut on the sheet. The cans are inserted upwardly into the openings and retained by the carrier by flexing of the periphery of each opening upwardly against the chime or bead of each can. As the cans are inserted, the film is stretched so that it is taut about the upper ends of the cans. The film is stretched substantially flat and taut from one peripheral edge to an opposite peripheral edge. The carrier thus protects the cans from contaminants. The carrier supports the array of the cans so that the upper ends of the cans are in a single plane when the package is lifted through finger openings in the film and sheet. The film and sheet define a substantially flat planar upper surface. Indicia such as printing, advertising, logos, artwork, and other markings are provided on the film preferably on the entire surface of the film.

36 Claims, 9 Drawing Sheets

CONTAINER PACKAGE

This invention relates to container packages and particularly to can packages.

BACKGROUND AND SUMMARY OF THE INVENTION

In the handling and the packaging of cans, it is common to use a carrier having an array of openings therein for receiving the upper ends f the cans and holding an array of cans to form a container package. Typical United States patents showing such a carrier are U.S. Pat. Nos. 3,874,502 and 4,219,117.

Such a carrier comprises a series of bands or rings which are non-circular and is applied by lateral stretching by a machine which inserts fingers into the openings to stretch the openings to a generally circular configuration an then the carrier is forced onto the upper end of the cans through the neck below the chime or bead on the cans. During the stretching 15 and application, the bands are folded downwardly along the peripheral surface of the necks of the cans. The resultant package comprises a plurality or array of the cans surrounded by the stretched plastic rings. In such a package, the upper ends of the cans are exposed. The package offers no area wherein the carrier can be provided with printing, advertising or other indicia. Furthermore, once the cans are removed from the carrie, it is difficult if not impossible to reinsert the cans. Accordingly, the cans can not be readily handled for returning the cans of salvage or reclaiming.

U.S. Pat. No. 3,335,013 discloses an arrangement wherein a thin plastic film is applied over the upper ends of the cans and then a carrier comprising elastic rings, such as shown in the aforementioned U.S. Pat Nos. 3,874,502 and 4,219,117, is applied over the film. Such an arrangement requires two separate steps. The resultant carrier is not aesthetically pleasing and only offers the possibility of indicia such as printing in the isolated areas of film overlying each container, the containers being spaced apart by the carrier. This requires properly registering the isolated areas over the cans and maintaining this registry during application of the carriers.

U.S. Pat. Nos. 3,137,109 and 3,200,944 show an arrangement wherein a thin plastic sheet is provided over a pasteboard carrier. The openings in the pasteboard carrier are greater than the diameter of the cans. The cans are inserted in the openings and then the plastic sheet is heated and stretched and formed by pressure differential into conformity with the upper ends of the cans and into underlying relationship with the peripheral edges of the openings. Moreover, the cans are only retained by deforming the plastic sheet. Such a construction obviously requires a number of steps and complex assembly aparatus. Such a carrier has a basic deficiency in that if the paste board becomes wet the carrier will not function. Furthermore, the cans are not securely retained in a paste board carrier.

U.S. Pat. No. 3,317,234 shows a similar construction wherein the periphery of the openings in the paste board carrier are preformed to the desired configuration.

Similarly, U.S. Pat. No. 3,601,439 shows a container package for cans where the carrier comprises a pasteboard sheet and a thin plastic film adhered by adhesive to the upper surface of the sheet in overlying relationship to apertures in the sheet. The periphery of the openings in the pasteboard sheet is formed by a plurality of fingers or corrugations which are deformed upwardly into contact with the chime or bed of the can. The fingers thus formed are described as preventing radially outward deflection of fingers. As shown, the cans are spaced from one another so that when the package is lifted, the cans will move vertically relative to one another an sag.

U.S. Pat. Nos. 4,586,742 and 4,724,655 disclose the concept of bonding a thin plastic film to the underside of a thick plastic ring carrier of the type disclosed in U.S. Pat. Nos. 3,874,502 and 4,219,117. The thin plastic film is bonded to the periphery of the ring carrier and extends downwardly from the undersurface thereof so that when the ring carrier is applied by engaging fingers with the openings, he film can be blown upwardly as the cans are inserted to cover the upper ends of the cans. In each of the patents which utilize a film, the ends of the cans are, in effect, individually covered by the film. Accordingly, wherein the thin plastic sheet is larger than the ring carrier providing a sufficient space so that when the carrier is stretched about the cans, the upper ends of the cans are covered by the film. They do not offer a construction wherein indicia including printing, decorations and logos can be readily applied and included as a part of the package. Furthermore, where each can is effectively covered by an isolated area of film, the film will be adversely affected and incapable of withstanding the normal handling, storage, shipping and stacking that such packages are subjected to and thus will adversely affect the effectiveness of the package or any indicia thereon.

A further problem with carriers of the common type which have an array o openings is that when an attempt is made to use the carriers for a large number of cans, for example 8 or 12 cans, and the package is lifted, the cans move axially relative to one another making the package sag. When the user lifts the package, such a package gives a sense of instability and a loss of can security. Furthermore, it is not convenient to grasp such a package through finger openings in the carrier. Where such packages have heretofore been proposed band has been provided about the carrier. Accordingly, it has been suggested that in ring carriers of the type shown, for example, in U.S. Pat. Nos. 3,874,502, 4,586,742 and 4,219,117, it is necessary to provide a band with an integral handle about the bodies of the cans where a larger number of cans are provided, such as twelve cans. See U.S. Pat. Nos. 4,269,308, 4,385,690, 4,385,691, 4,471,010 and 4,520,924.

Alternatively, it is common to provide a larger number of cans in cardboard boxes or to provide a shrink film about a large group of cans as shown, for example, in U.S. Pat. No. 4,289,236.

Among the objectives of the present invention are to provide a container package which utilizes a carrier that will properly protect the upper ends of the containers such as cans; which will effectively maintain the upper ends of the cans in a single plane when the package is lifted, even when a larger number of cans are lifted such as twelve cans; which will withstand the conditions of handling, storage, shipping and stacking; which will be aesthetically pleasing; wherein indicia such as printing can be applied over a large substantially undisturbed planar surface for advertising and the like; wherein the carrier can be used for returning the containers for salvage or recycling; and which can be applied to the cans at commercially acceptable speeds.

Among the further objectives of the present invention are to provide a container package which holds the containers such as cans in tight side-by-side relationship when the package is lifted so that it is readily handled and transported; wherein each can can be readily released by a downward movement relative to the carrier; wherein each container can be readily reinserted; wherein no additional band is required about the cans; and which is cost effective.

In accordance with the invention, the container package comprises an array of cans and a carrier. The carrier includes a sheet of stiff but flexible plastic material having a plurality of openings forming an array for receiving the ends of the cans and a film of plastic material coextensive with the sheet and bonded to the periphery of the sheet so that it is flat and taut on the sheet. The cans are inserted upwardly into the openings and retained by the carrier by flexing of the periphery of each opening upwardly against the chime or bead of each can. As the cans are inserted, the film is stretched taut over the upper ends of the cans. The film is stretched substantially flat and taut from one peripheral edge to an opposite peripheral edge. The carrier thus protects the cans from contaminants. The carrier supports the array of the cans so that the upper ends of the cans are in a single plane when the package is lifted through finger openings in the film and sheet. The film and sheet define a substantially flat planar upper surface. Indicia such as printing, advertising, logos, artwork and other markings are provided on the film preferably on the entire surface of the film.

DESCRIPTION OF THE DRAWINGS

FIG. 16 is a perspective view of a package embodying the invention being lifted by and.

DESCRIPTION

Figure 1:
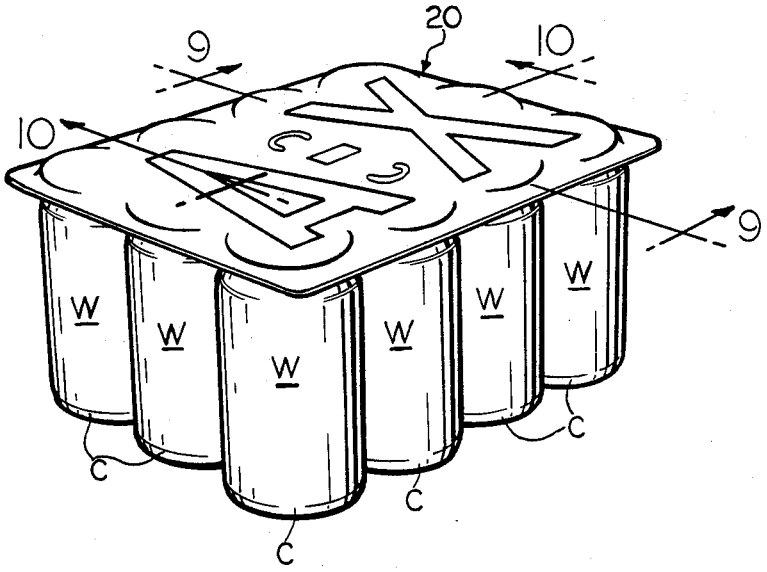
FIG. 1 is a perspective view of a container package embodying the invention.

Referring to FIG. 1 the container package embodying the invention comprises a carrier 20 including a plurality or array of containers C, such as 12 cans, supported so the side walls W of the containers C are in adjacent abutting relation. As is common in cans, the cans include an annular chime or bead B that is connected to the side wall W by a tapered neck portion N (FIGS. 9, 10).

Referring to FIGS. 2–6, the carrier 20 comprises a sheet 21 of relatively stiff flexible plastic of uniform thickness which is generally rectangular and has a plurality of openings 22 corresponding in number to the number of cans for the package, preferably twelve. The openings 22 have a cross sectional area slightly less then the diameter of the cans below the bead B. As shown, the openings 22 are circular.

The carrier 20 further includes a film 23 which is thinner then the sheet 21 and is coextensive with the sheet 21 and bonded about the periphery 24. The bonding at the periphery of the lines is preferably by heat. The carrier 20 further includes portions partially cut to form accurate slots 25 in the film 23 and sheet 21 to define tabs 26 (FIG. 2), each of which comprises a layer of plastic from the carrier sheet 21 and a layer of plastic from the film 23. Tabs 26 are adapted to be bent downwardly to provide openings to receive the fingers of a hand in order to lift and carry the package, the openings being preferably spaced transversely of one another. Accurate bonding lines 27 are provided about the periphery of the tabs 26 so that the portion of the sheet 21 and corresponding portion of the film 23 which overlies the sheet 21 and forms the tabs 26 minimizing the likelihood of detachment of the film from the sheet at the tabs.

Figure 9A:
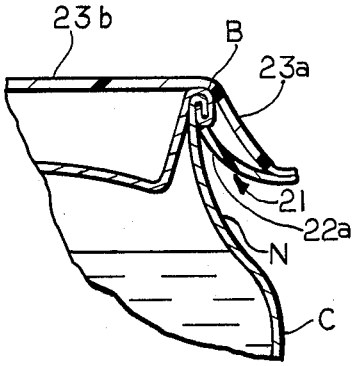
FIG. 9A is fragmentary sectional view on an enlarged scale of portions of the package shown in FIG. 9.
Figure 9:
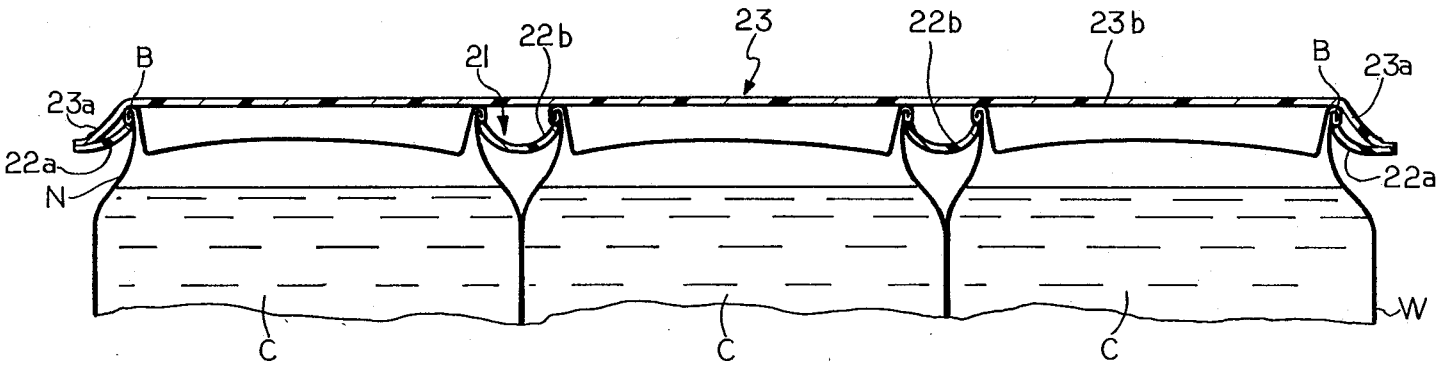
FIG. 9 is a fragmentary longitudinal sectional view of a portion of a package taken along the line 9—9 in FIG. 1.
Figure 10:
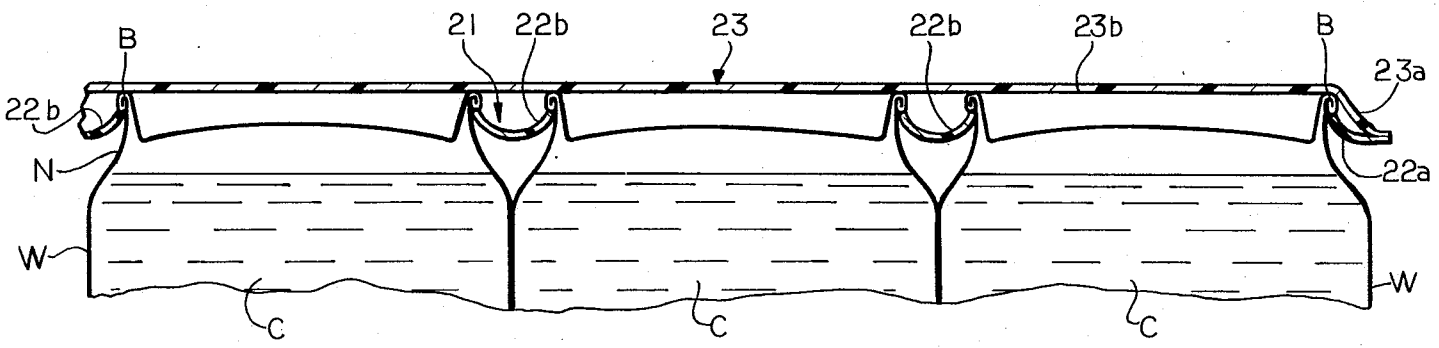
FIG. 10 is a fragmentary sectional view of a portion of a package taken along the line 10—10 in FIG. 1.

As shown in FIGS. 9 and 10, when the carrier 20 is applied to the cans either by progressively forcing the carrier downwardly onto an array of cans from one end of the array to the other or by simultaneously forcing the carrier downwardly onto the array, the portions **22*a* of the periphery of the openings 22 are flexed upwardly about the beads B of the cans C and then flexed radially inwardly below the beads B. It may be noted that the periphery of the portion of the carriers surrounding the opening flexes only sufficiently to extend upwardly beneath the bead (FIG. 9**) but preferably not such that it is stretched and engages and conforms to the neck N of the can C as occurs in conventional ring type can carriers. Such ring type carriers that are commercially used at the present time are shown in the aforementioned U.S. Pat. Nos. 3,874,502, 4,219,177, and 4,586,742.

As shown in FIG. 10, in a longitudinal direction, the film 23 is flexed about the upper ends of the cans so that the portion **23*a* of the film at the periphery is inclined upwardly and inwardly toward the tops of the peripheral cans and the remainder of the film between the peripheral edges in the longitudinal direction is taut and extends generally parallel to the sheet 21 or horizontally when the package is on a horizontal surface. The entire portion 23*b* overlying the cans is taut an extends horizontally. As shown in FIG. 9, similarly in a transverse direction, the film portions 23*a* at the periphery are also inclined upwardly and inwardly toward the tops of the cans and the portion 23***b*. The entire portion 23*b* of the film over the tops of the cans is taut and extends horizontally.

The center to center distance between adjacent openings 22 before the carrier is applied is not greater than and preferably slightly less than the center to center distance between abutting cans. The film 23 functions, in addition, to maintain the periphery of the sheet 21 in a substantially single plane. The film 23 thus defines a large substantially planar surface overlying both the ends of the cans and the sheet 21.

It is preferred that the film 23 be unbonded to the sheet 21 except for the peripheral portion and the portions bonding the layers of the finger tabs.

The proper flexing of the periphery of each opening about the can and beneath the bead of each can is achieved by placement of the center of each opening so that the body of the cans abut one another and the film is stretched taut over the upper ends of the cans.

The sheet of flexible stiff plastic has a uniform thickness and a sufficiently high modulus of elasticity so that the periphery of the openings will flex about the upper ends of the cans only sufficiently to hold the cans and maintain the cans in contact along the body portions of the carrier and will maintain the upper ends of the cans in substantially the same plane when the package is lifted.

Figure 2:
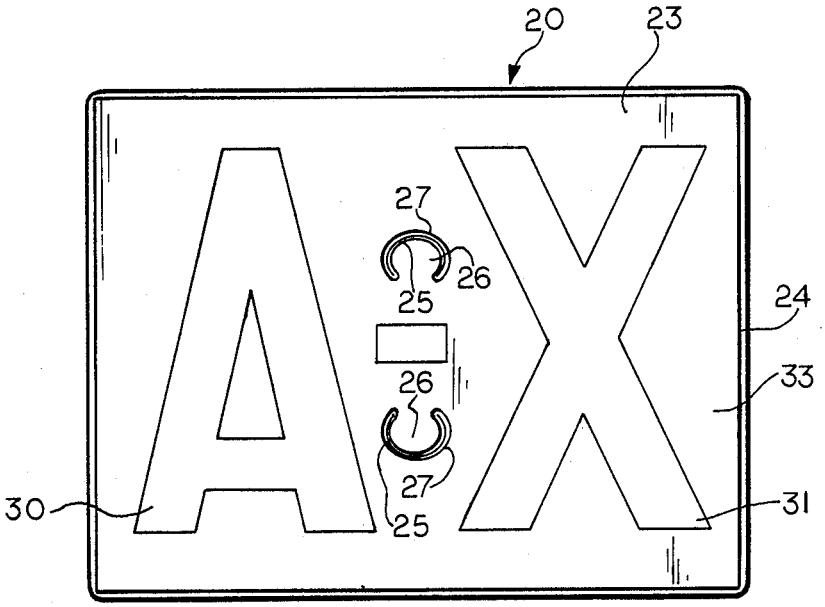
FIG. 2 is a plan view of the carrier utilized in the package shown in FIG. 1.
Figure 3:
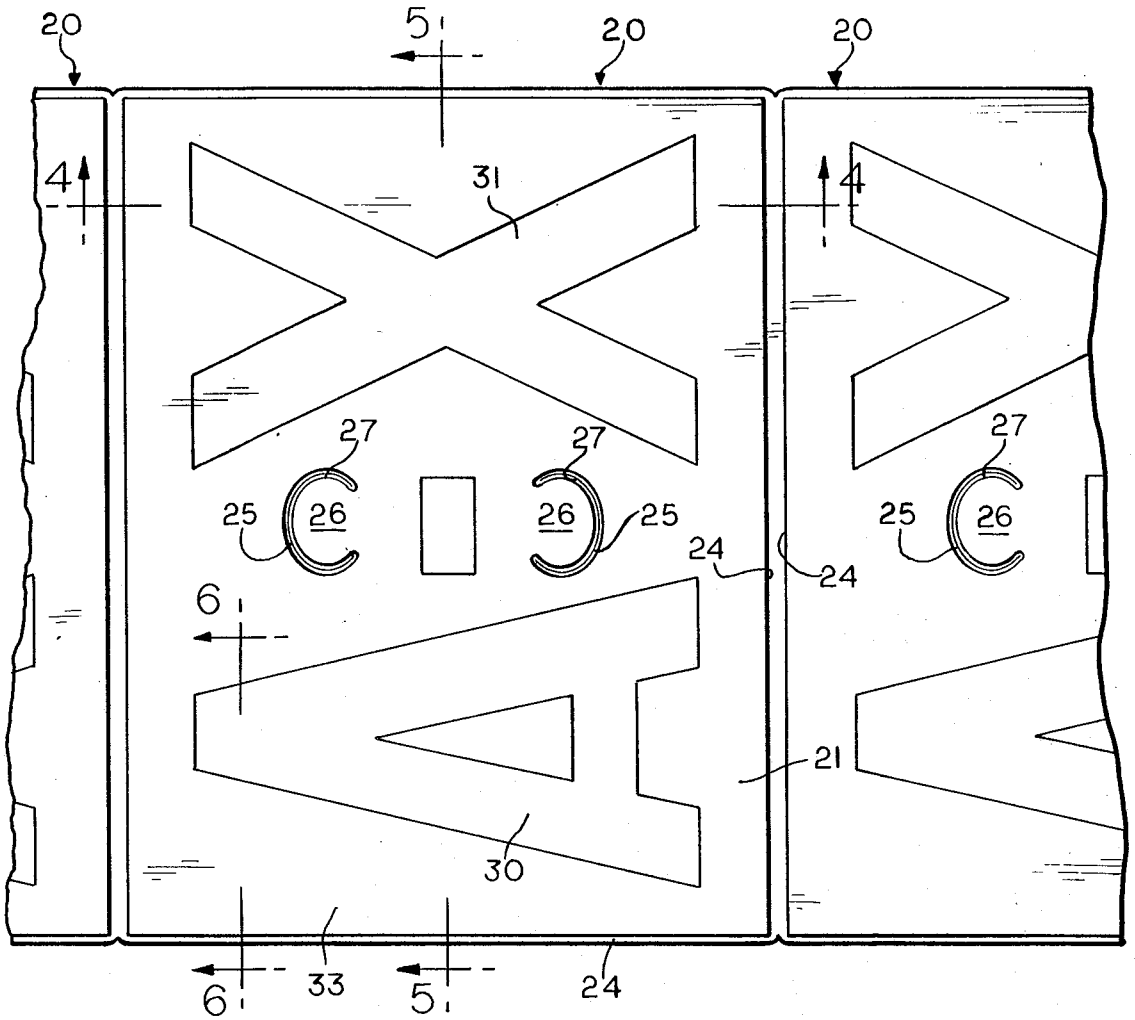
FIG. 3 is a plan view of the portion of a roll of carriers utilized in the package.
Figure 4:
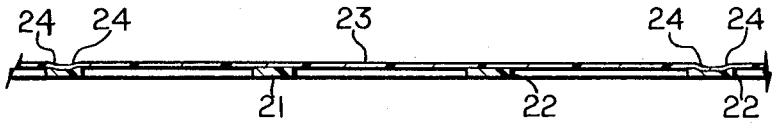
FIG. 4 is a longitudinal sectional view taken along the line 4—4 in FIG. 3.
Figure 5:
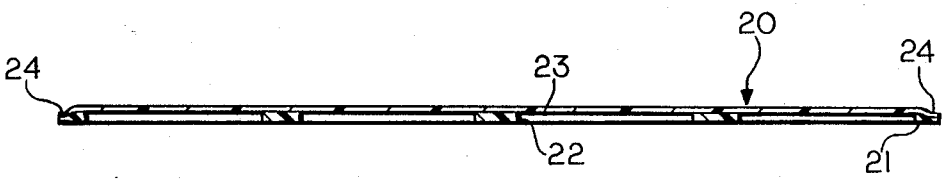
FIG. 5 is a longitudinal sectional view through the package taken along the line 5—5 in FIG. 3.
Figure 6:
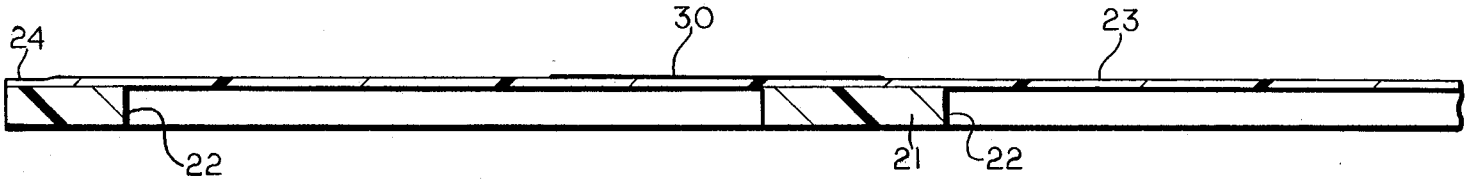
FIG. 6 is a fragmentary sectional view taken along the line 6—6 in FIG. 3.

As shown in FIGS. 1–3, indicia 30, 31 are printed to form a trademark or logo designation. In addition the area 33 surrounding the indicia 30, 31 can be provided with other indicia such as printing, advertising, logos, artwork and other markings forming a background or design about the indicia so that the entire surface of the film 23 is covered providing an aesthetically pleasing package and increased advertising space.

As shown in FIG. 2, the indicia 30, 31 and other markings 33 or background may be applied by printing on the outer surface of the film 23. Alternatively, the indicia may comprise an opaque color to the film or sheet.

It has been found that the film 23 is substantially uniformly stretched from one peripheral edge to the opposite peripheral edge. As a result, the indicia can be applied over the entire surface of the carrier without unsightly distortion of the indicia by the stretching of the film 23 during application.

Figure 7:
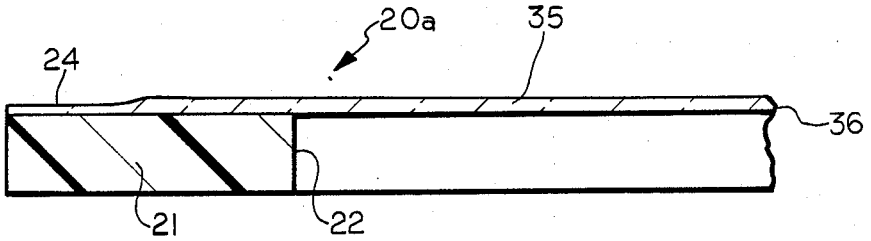
FIG. 7 is a fragmentary sectional view on an enlarged scale of a portion of a modified from of the carrier.

In a preferred form of carrier 20*a* shown in FIG. 7, film 35 is transparent and the indicia 36 are provided on the underside of the film 35. In all other respects this form is constructed like that shown in FIGS. 1–6. This form has the advantage of protecting the indicia from scuffing when packages are handled or stacked on one another for shipping or display.

Figure 8:
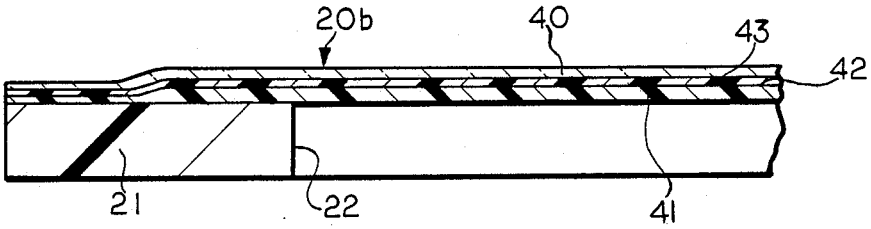
FIG. 8 is a fragmentary sectional view on an enlarged scale of a portion of a further modified form of carrier.

In the form of carrier 20*b* shown in FIG. 8, the film comprises an outer transparent film layrr 40 having indicia 43 on the underside of layer 40 and an inner film layer 41. The indicia 43 are formed on the inner surface of layer 40 or 41 and an adhesive 42 bonds the two layers to one another to form a single film.

It can thus be seen that where the indicia are provided on the underside of the film, they are less subjected to abrasive action of the cans on another package during the application to the cans, normal handling, storage and stacking of one package on another. Where the indicia are provided between two layers of film, abrasive action of the printing ink with the upper ends of the cans in the package, which might mar the indicia, is obviated.

Figure 14:
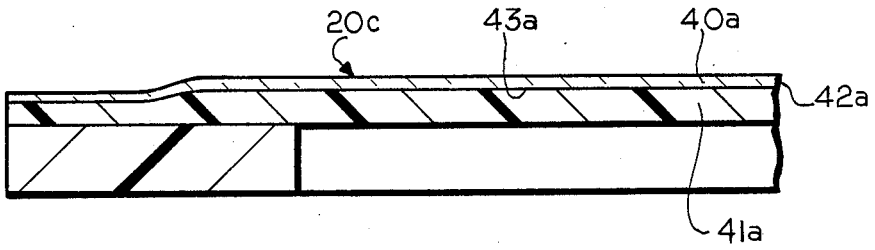
FIG. 14 is a fragmentary sectional view on an enlarged scale of a portion of an additional form of carrier.
Figure 15:
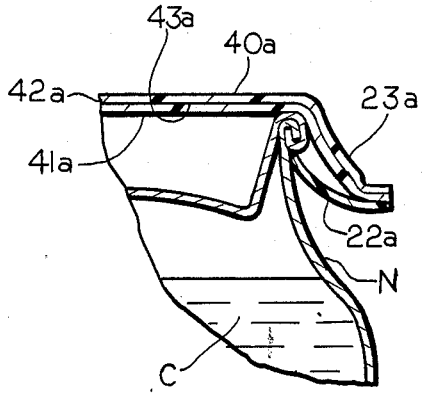
FIG. 15 is a fragmentary sectional view of a portion of a package utilizing the carrier shown in FIG. 14.

In the form of the carrier shown in FIGS. 14 and 15, the carrier 20*c* is similar to that shown in FIG. 8 except that the transparent layer 40*a* having indicia on the underside and film layer 41*a* are not bonded by an adhesive to one another. By this arrangement, when the carrier is applied to the array of cans, the outer film layer 40*a* and the inner film layer 41*a* can slide or move relative to one another minimizing any tendency to deform or mar the indicia 43*a* during application of the carrier to the cans.

The forms wherein the film comprises two layers permits making the outer layer and the inner layer with different properties to accommodate peripheral bonding. Thus, the inner layer can have a lower sealing temperature than the outer layer or the sheet to facilitate heat bonding.

Figure 13:
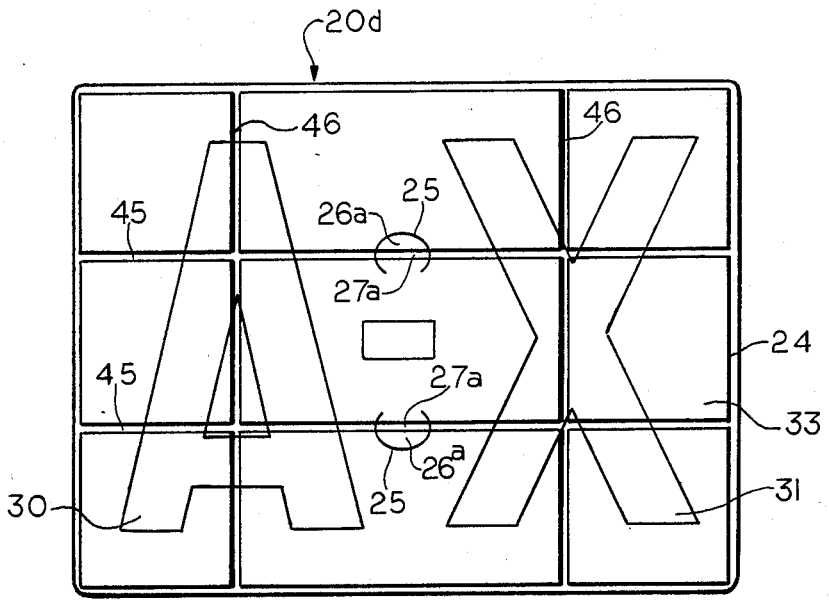
FIG. 13 is a plan view of a modified form of package.

In the modified form of carrier 20*d* shown in FIG. 13, the tabs 26*a* are formed by partially cutting portions of the film and carrier but the portions of the bonding lines 27*a* extend across the tabs. In addition, in this carrier 20*d*, additional bond lines 45 extend lengthwise or loniitudinally and additional bond lines 46 extend transversely.

In each of the forms of carrier, printing or indicia can be provided on the entire surface of the film to provide advertising or otherwise aesthetically enhance the package.

The provision of the peripheral bonding provides for minimizing the possibility of contaminants entering beneath the carrier and film and assists in maintaining the peripheral edge of sheet 21 in a substantially flat plane and enhances the appearance of the package (FIGS. 1, 9, 10).

It has been found that the sealing at the periphery facilitates the application of the carrier to the cans and obviates the need for auxiliary forces such as heating and deforming by heating, differential pressure or mechanical forming of the carrier about the can. In addition, the use of peripheral bonding of the film to the carrier facilitates the manufacture of the carrier.

Figure 10A:
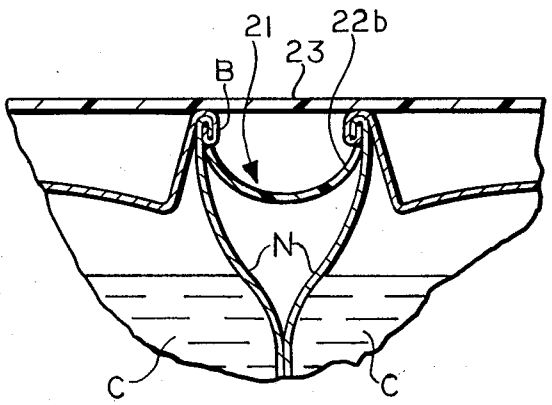
FIG. 10A is a fragmentary sectional view on an enlarged scale of a portion of the package shown in FIG. 10.
Figure 16:
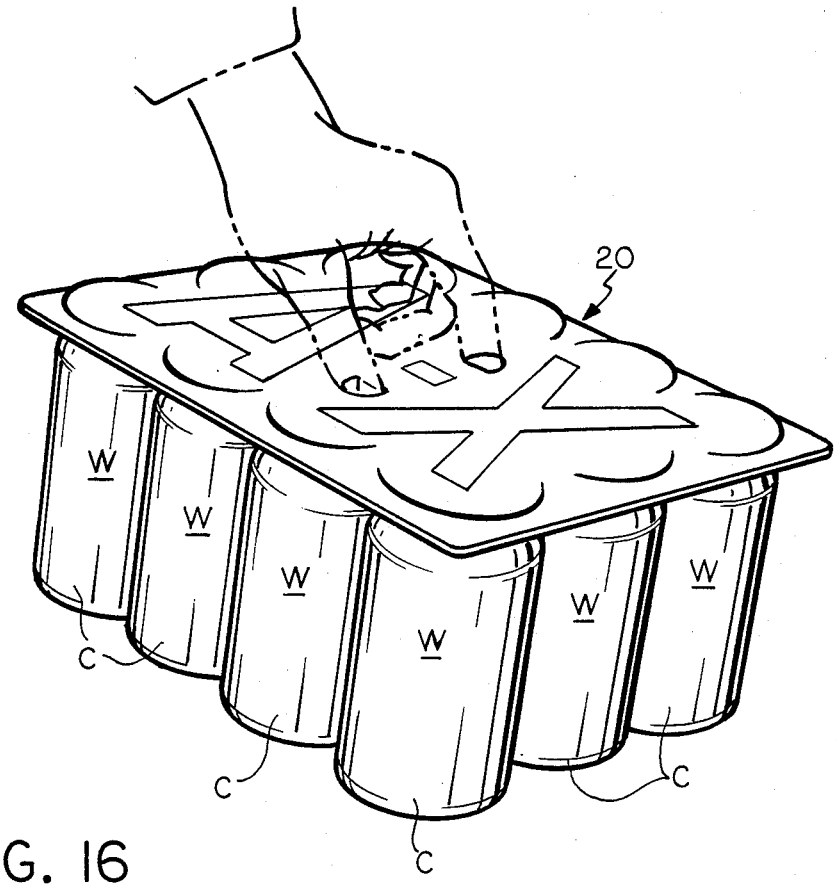

By utilizing a sheet 21 that has sufficient stiffness, there is provided a series of V-shaped beams between the cans about the periphery of the openings, the free edges 22*b* of which engage the beads B of the cans (FIGS. 9, 10, 10A). The free edges 22*b* extend upwardly and inwardly toward the centerline of the can at an acute angle to the centerline. These beams further stiffen the package so that when it is lifted, the upper ends of the cans lie in substantially the same plane without relative movement or sagging between the cans and without the cans at the periphery flairing outwardly out of contact with remaining cans. This is shown for example by reference to FIG. 16. Such action is further enhanced by the film which is bonded to the carrier. The film 23 should have a lower modulus of elasticity and thickness so that it will be flat against the sheet 22 and yet will stretch sufficiently over the ends of the cans and remain taut over the ends of the cans. Further, the film should be such that it is taut when it is on the carrier before insertion of the cans as well as taut over the ends of the cans to define the large planar surface.

Figure 11:
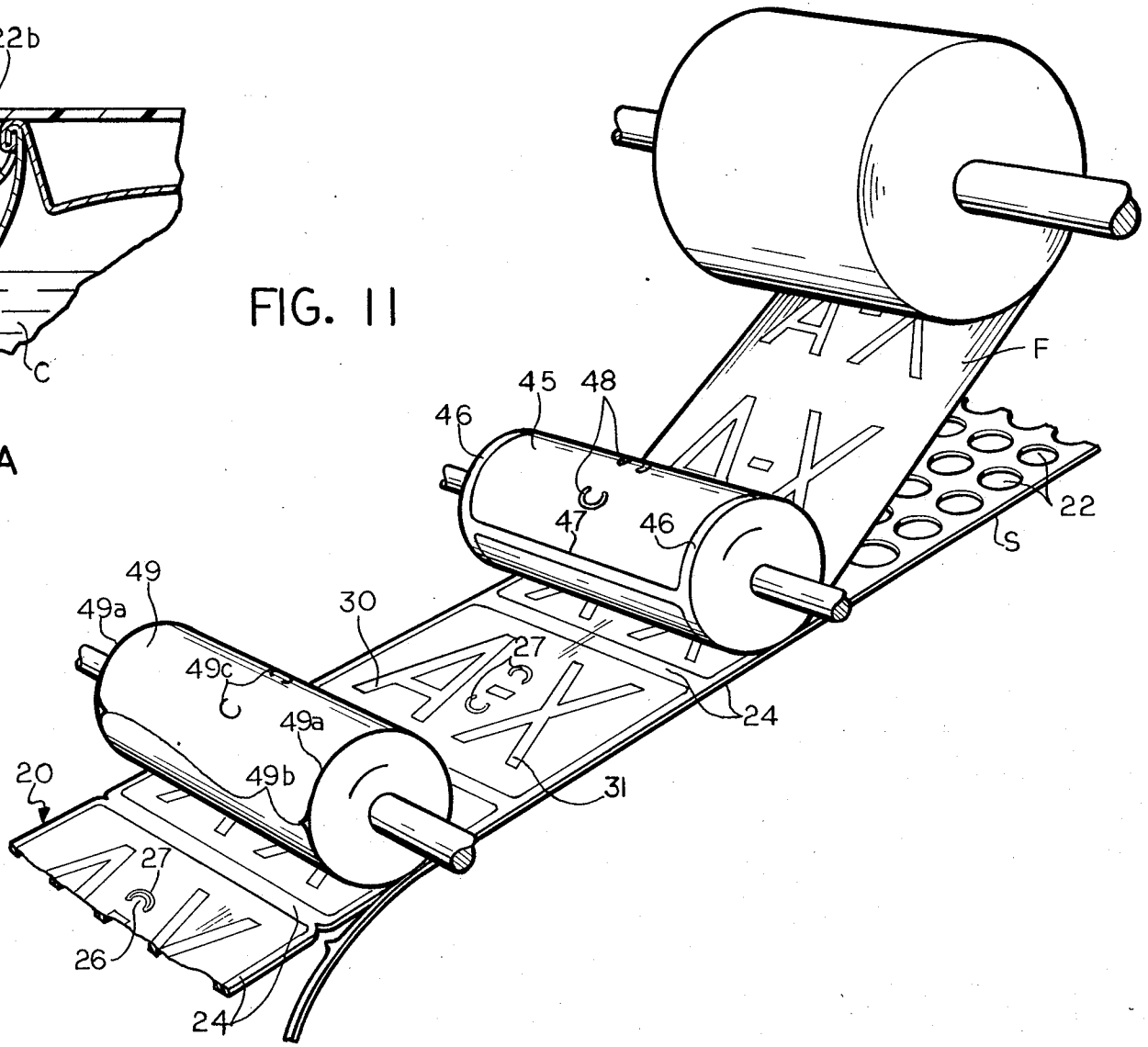
FIG. 11 is schematic perspective view showing the making of the carrier.

Referring to FIG. 11, the carriers are preferably formed by first forming a strip S with openings 22 and feeding the strip S and a web of film F from a roll between a heated roller 45 that has longitudinal heated ribs 46 that bond the film to a strip of carriers along the periphery 24. Transverse ribs 47 comprise spaced ribs thereby defining separate carriers that can be severed. The transverse ribs 47 comprise ribs of double widths so that when the carriers are subsequently cut from the web, a desired peripheral edge 24 is provided. Roll 45 includes accurate bonding portions 48 for bonding the portions from which tabs 26 are to be formed.

The web of carriers is then passed through a die cutting roll 49 which includes cutting edges 49*a* that trim the side edges, cutting portions 49*b* that trim the corners, and cutting edges 49*c* that simultaneously form the finger tabs 26.

Figure 12:
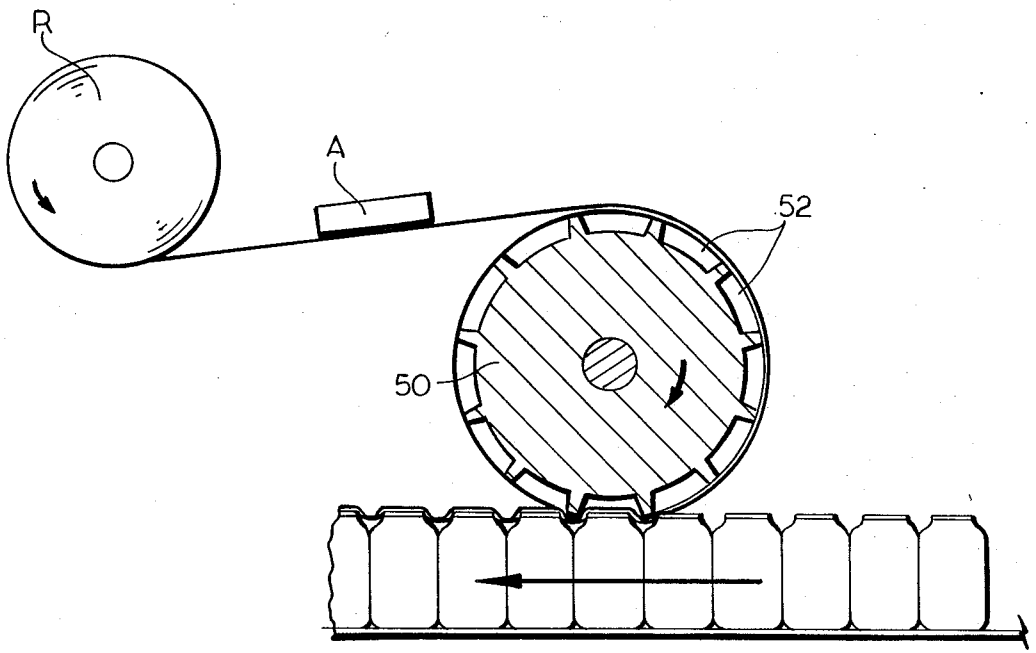
FIG. 12 is a schematic view showing the method of application of the carrier.

By this method a roll R of carriers is provided that can then be applied to successive arrays of cans as shown in FIG. 12. Where the carrier comprises two separate layers of film, the layers are successively bonded to the sheet S by successive heated rollers.

A strip of carriers is delivered from roll R to a wheel 50 that has arrays of circular openings, the periphery which progressively apply the carriers to the cans, after which the carriers with cans thereon are severed from one another. If needed, moderate heat may be applied by a heater A to soften the film to not greater than the melting point thereby insuring the uniform stretching of the film over the cans.

As each carrier is applied progressively to an array of cans, it is moved downstream after which it can be severed from the preceding carrier which has been applied to a can.

It has been found that the sheet 21 (FIGS. 4–6) of the carrier should preferably be made of a plastic material that is flexible but stiff and yet has sufficiently high modulus of elasticity as to tend to retain the cans in the original plane, especially when used in conjunction with the film. Such stiffness is obtained by utilizing a high modulus material and having sufficient thickness n the sheet to provide the desired attribute of retaining the cans and holding the cans in an array such that the upper ends of the cans are maintained in substantially the same plane when the package is lifted utilizing the finger openings. This permits the package to be carried more readily especially where the package comprises twelve cans.

It has been found that a satisfactory package may be made of material such as a polyolefin. Specifically, the sheet comprises high density polyethylene and the film comprises linear low density polyethylene. Satisfactory results have been achieved where the high density polyethylene sheet 21 has a thickness of 14 mils and the linear low density polyethylene film has a thickness of 3 mils. In the form shown in FIGS. 8 and 14, the outer layers may be about 1.5 mil each, which provide a total film thickness of 3 mils.

Satisfactory results for retaining 12 ounce cans having a filled weight of 0.85 pounds per can are achieved where the sheet 21 has a thickness of 14 mils $\pm 1$ and the film has a total thickness ranging between about 1 to 3 mils for the aforementioned respective materials of high density polyethylene and linear low density polyethylene.

An example of a package shown in FIG. 14 comprises a sheet 21 of high density polyethylene having a melt index of 0.25, a density of 0.960 gm/cc and a thickness of 14 mils made by Allied Chemical Company and sold under the designation AA 60003. In such a package, the film 23 comprises an outer transparent layer and an inner opaque layer; the outer layer having the indicia printed thereon and comprising a linear low density polyethylene having a melt index of 2.0, a density of 0.920 gm/cc and a thickness of 1.5 mils made by Dow Chemical Company and sold under the designation Dowlx 2045; and the inner opaque layer comprising an ultra low density polyethylene having a melt index of 3.3, a density of 0.912 gm/cc and a thickness of 0.5 mils made by Dow Chemical Company and sold under the designation Attane 4002.

It has been found that a package made in accordance with the invention will withstand normal handling, storage, shipment and stacking without adversely affecting either the effectiveness of the package, the appearance and indicia or the ability to stack one package on another.

In addition, it may be noted that the carrier has the advantage that it does not provide unrestricted openings but rather covered openings so that it is less likely to be objectionable from the environmental standpoint with respect to possible entrapment of fish or wild life.

The carrier made in accordance with the invention may be contrasted to conventional ring type carriers presently used for holding cans in that the presently used carriers such as shown in the aforementioned U.S. Pat. Nos. 3,137,109 and 3,200,944 rely on predominately tensile forces to engage the neck of the cans below the beads along a cylindrical portion of the neck. In the carrier of the present invention, the relatively stiff sheet of the carrier engages under the beads of the cans and does not rely on engagement with a large surface of the neck of the can for holding the cans in position. The carrier also holds the cans in abutting relation to one another. Upon lifting of the package to carry it utilizing the finger openings, the upper ends of the cans remain in the same plane and the lower ends of the cans remain in contact and do not flair outwardly relative to one another even when the package is tilted from the horizontal. In the carrier of the present invention, the carrier i further stiffened by the film to assist in maintaining the upper ends of the cans in the same plane and hold the periphery of the sheet horizontal.

It can thus be seen hat there has been provided a container package which utilizes a carrier that will properly protect the upper ends of the cans; which will effectively maintain the upper ends of the cans in a single plane when the package is lifted, even when a larger number of cans are lifted such as twelve cans; which will withstand the conditions of handling, storage, shipping and stacking; which will be aesthetically pleasing; wherein indicia such as printing can be applied for advertising and the like; wherein the carrier can be used for returning the containers for salvage or recycling; and which can be applied to the cans at commercially acceptable speeds.

It can further be seen that there has been provided a container package which holds the cans in tight side-by-side relationship wherein the package is lifted so that it is readily handled and transported; wherein each can can be readily released by a downward movement relative to the carrier; wherein each container can be readily reinserted; wherein no additional band is required about the cans; and which is cost effective.

Although the invention has been described in connection with cans, it is also applicable to other containers having a top, a peripheral bead or shoulder, a side wall and an inclined portion extending upwardly and inwardly toward the bead.

We claim:

1. A container package for cans having a top, a peripheral bead, a side wall and an inclined portion extending upwardly and inwardly toward the bead and a carrier comprising a sheet of flexible plastic material having a plurality of openings for receiving the upper ends of the cans, a film of plastic material coextensive with said sheet and bonded at the periphery to the upper surface of the sheet, said cans extending upwardly through the openings in the sheet with the periphery of tee openings flexing upwardly and inwardly beneath the bead, said film being stretched over the upper ends of the cans when the cans are in position relative to the sheet such that the film is taut between cans, the portions of the film which extend from the bonded periphery and overly the cans being taut, the modulus of elasticity of said sheet, the thickness of said sheet, and the spacing and size of said openings being such that the cans are maintained in abutting relationship of the bodies thereof, the plane of the sheet remains substantially undisturbed, and the upper ends of the cans are maintained in substantially the same plane when the package is lifted by engaging the carrier, the modulus of elasticity and thickness of the film being such that the film lies flat and taut on the carrier before application of the cans and is stretched and remains taut over the upper ends of the cans when the carrier is applied to the cans.

2. The container package set forth in claim 1 wherein said bonded area comprises solely the periphery of the sheet.

3. The container package set forth in claim 2 wherein said bonded areas extend entirely about the periphery.

4. The container package set forth in claim 1 wherein said film is bonded to the remainder of the carrier along one direction between the cans from one peripheral edge of the carrier to an opposite peripheral edge of the carrier.

5. The container package set forth in claim 1 including overlying finger receiving tabs partially cut from film and sheet, said tabs being at least partially heat bonded to one another.

6. The container package set forth in claim 5 wherein said openings are substantially accurate.

7. The container package set forth in claim 1 including an intermediate film layer interposed between said first mentioned film layer and said sheet.

8. The container package set forth in claim 7 wherein said intermediate film layer is adhered to said first mentioned film layer.

9. The container package set forth in claim 7 wherein said first mentioned film layer is transparent including indicia on the underside of said first mentioned film layer.

10. The container package set forth in claim 9 wherein said indicia are over substantially the entire surface of said film.

11. The container package set forth in any one of claims 1–6 including indicia on said film.

12. The container package set forth in claim 11 wherein said indicia are on the outer surface of said film.

13. The container package set forth in claim 11 wherein said indicia are on the under surface of said film.

14. The container package set forth in claim 11 wherein indicia are provided over substantially the entire surface of said carrier.

15. The container package set forth in any one of claims 1–10 including twelve cans, said sheet having twelve openings therein, said cans extending into said openings.

16. The container package set forth in any one of claims 1–10 wherein the sheet and film are made of a polyolefin.

17. The container package set forth in any one of claims 1–10 wherein said sheet is made of a high density polyethylene material and said film is made of a linear low density polyethylene material.

18. The container package set forth in any one of claims 1–10 wherein said sheet is made of high density polyethylene sheet and the thickness ranges between about 14±1 mils and the total thickness of the low density polyethylene film ranges between about 1 to 3 mils.

19. A carrier for a container package for cans having a top, a peripheral bead, a sidewwall and an inclined portion extending upwardly and inwardly toward the bead, said carrier comprising.

a sheet of flexible plastic material having a plurality of openings for receiving the upper ends of the cans, a film of plastic material coextensive with said sheet and bonded at the periphery to the upper surface of the sheet such that cans can be inserted and extend upwardly through the openings in the sheet with the periphery of the openings flexing upwardly and inwardly beneath the bead, and said film being taut and in contact with the upper surface of said sheet such that it is adapted to be stretched over the upper ends of the cans when the cans are in position relative to the sheet such that the film is taut between cans, the portions of the film which extend from the periphery and overly the cans will be taut, the modulus of elasticity of said sheet, the thickness of said sheet, and the spacing and size of said openings being such that when the carrier is applied to an array of cans, the cans are maintained in abutting relationship of the bodies thereof, the plane of the sheet remains substantially undisturbed, and the upper ends of the cans are maintained in substantially the same plane when the package is lifted by engaging the carrier, the modulus of elasticity and thickness of the film being such that the film lies flat and taut on the carrier before application of the cans and is stretched and remains taut over the upper ends of the cans when the carrier is applied to the can.

20. The carrier set forth in claim 19 wherein said bonded areas comprises solely the periphery of the sheet.

21. The carrier set forth in claim 19 wherein said bonded areas extend entirely about the periphery.

22. The carrier set forth in claim 19 wherein said film is bonded to the remainder of the carrier along at least in one direction between the cans from one peripheral edge of the carrier to an opposite peripheral edge of the carrier.

23. The carrier set forth in claim 19 including finger receiving tabs partially cut from the film and sheet, said tabs being at least partially heat bonded to one another.

24. The carrier set forth in claim 23 wherein said openings are substantially accurate.

25. The carrier set forth in claim 19 including an intermediate film layer interposed between said first mentioned film layer and said carrier.

26. The carrier set forth in claim 25 wherein said intermediate film layer is adhered to said first mentioned film layer.

27. The carrier set forth in claim 26 wherein said first mentioned film layer is transparent including indicia on the underside of said first mentioned film layer.

28. The carrier set forth in claim 27 wherein said indicia are over substantially the entire surface of said carrier.

29. The carrier set forth in any of claims 19–24 including indicia on said film.

30. The carrier set forth in claim 29 wherein said indicia are on the outer surface of said film.

31. The carrier set forth in claim 29 wherein said indicia are on the under surface of said film.

32. The carrier set forth in claim 29 wherein said indicia are provided over substantially the entire surface of said film.

33. The carrier set forth in any of claims 19–28 wherein said sheet has twelve openings therein.

34. The carrier set forth in any of claims 19–28 wherein the sheet and film are made of polyolefin.

35. The carrier set forth in any of claim 19–28 wherein said sheet is made of a high density polyethylene material and said film is made of a linear low density polyethylene material.

36. The carrier set forth in any of claim 19–28 wherein said sheet is made of high density polyethylene sheet and the thickness ranges between about 14± mils and the total thickness of the low density polyethylene film ranges between about 1 to 3 mils

* * * * *

UNITED STATES PATENT AND TRADEMARK OFFICE

CERTIFICATE OF CORRECTION

PATENT NO. : 4,911,290 (Page 1 of 2)

DATED : Mar. 27, 1990

INVENTOR(S) : James A. Karabedian and David A. Pratt

It is certified that error appears in the above—identified patent and that said Letters Patent is hereby corrected as shown below:

ON TITLE PAGE:

Abstract

Line 5, after "cans" insert — and —.

Column 1

Line 11, delete "f" and insert — of — in place thereof.
Line 19, delete "an" and insert — and — in place thereof.
Line 31, delete "of" and insert — for — in place thereof.

Column 2

Line 17, delete "he" and insert — the — in place thereof.
Line 36, delete "o" and insert — of — in place thereof.

Column 4

Line 28, delete "accurate" and insert — arcuate — in place thereof.
Line 35, delete "Accurate" and insert — Arcuate — in place thereof.

Column 6

Line 24, delete "loniitudinally" and insert — longitudinally — in place thereof.

UNITED STATES PATENT AND TRADEMARK OFFICE

CERTIFICATE OF CORRECTION

PATENT NO. : 4,911,290

DATED : Mar. 27, 1990

INVENTOR(S) : James A. Karabedian and David A. Pratt

It is certified that error appears in the above—identified patent and that said Letters Patent is hereby corrected as shown below:

Column 9

Line 12, delete "tee" and insert -- the -- in place thereof.

Column 10

Line 22, delete "sidewwall" and insert -- side wall -- in place thereof.

Signed and Sealed this

Twenty-second Day of October, 1991

*Attest:*

*Attesting Officer*

HARRY F. MANBECK, JR.

*Commissioner of Patents and Trademarks*